US005425156A

United States Patent [19]

Strait et al.

[11] Patent Number: 5,425,156

[45] Date of Patent: Jun. 20, 1995

[54] WINDOW CRANK ASSEMBLY

[76] Inventors: Steven L. Strait, 4251 Mound Rd., Joliet, Ill. 60436; Randy W. Strait, 5960 Lakebluff, Tinley Park, Ill. 60477

[21] Appl. No.: 104,685

[22] Filed: Aug. 11, 1993

[51] Int. Cl.[6] ..... A47B 95/02; E05B 1/00

[52] U.S. Cl. ..... 16/114 R; 16/121

[58] Field of Search ..... 16/114 R, 121

[56] References Cited

U.S. PATENT DOCUMENTS 3,313,057 4/1967 Leddy ..... 16/121

5,216,781 6/1993 Brondfield ..... 16/144 R

*Primary Examiner*—P. Austin Bradley

*Assistant Examiner*—Chuck Y. Mah

*Attorney, Agent, or Firm*—Ernest Kettelson

[57] ABSTRACT

A window crank assembly for casement windows comprising a metal window crank having wing type hand grasp members extending laterally in both opposite directions from a central hub and a plurality of insert members, which are preferably metal but may also be plastic, receivable in the cavity of the hub, each of the insert members having an insert cavity of a different cross-sectional dimension and internal configuration to match the different cross-sectional dimension and external configuration of the different crankshafts of casement window operators made by the various casement window manufacturers. A set screw extends through aligned apertures of both the window crank hub and one of the inserts when received therein to bear against a portion of the casement window crankshaft received in the insert cavity which is inwardly thereof from an enlarged outwardly projecting spline portion of the crankshaft. This prevents removal of the window crank assembly from the crankshaft until the set screw is loosened enough to clear the enlarged outwardly projecting spline portion of the shaft.

15 Claims, 4 Drawing Sheets

WINDOW CRANK ASSEMBLY

BACKGROUND OF THE INVENTION

This invention relates to a window crank assembly to open and close casement windows, and in particular to a universal type of crank assembly which can be adapted for use on the crankshaft of any casement window operator of any manufacturer.

Prior art devices of this kind of which the inventors are aware include those disclosed in the following United States and foreign patents.

U.S. Pat. No. 5,216,781 which was recently issued discloses a low profile crank handle having a winged hub with a hub cavity to receive any one of a plurality of plastic inserts each of which are adapted for use with different types of crankshafts of different casement window manufacturers, wherein the hub cavity has an annular locking shoulder to hold the plastic insert within the hub cavity after it has been inserted by forcing past the annular locking shoulder after which its peripheral wall snaps back in place.

U.S. Pat. No. 5,025,826 discloses a faucet assembly which can be mounted on a variety of faucet valve stems utilizing a pair of jaws having inner surfaces for engaging opposite sides of the faucet valve stem, outer cam surfaces of the jaws which bear against a co-operative cam surface of the receiving cavity, and a screw which draws the pair of cammed surface jaws upward while bearing against the cam surface of receiving cavity thereby causing the jaws to grip the upper end of the faucet valve stem.

U.S. Pat. No. 4,984,489 discloses an accessory for a hand drill which co-operates with the crank handle of the opening mechanism of a casement window. The accessory includes a shaft which is gripped by the chuck of the hand drill, the shaft having a crank handle engaging head at its opposite end to rotate the window crank when the hand drill drive shaft and chuck are rotated.

U.S. Pat. No. 4,961,443 discloses a handle assembly which provides a decorative handle having a hub cavity to receive an insert member with a splined cavity in the insert member, also external splines on the insert which is received in a splined opening through the bottom bar of a two part operating lever, the insert member held to the valve stem by a first downwardly extending screw and to the decorative handle by a second upwardly extending screw.

U.S. Pat. No. 4,876,766 discloses a decorative faucet handle having an adapter with a first bore configured to fit the faucet stem, a second bore aligned with a bore through the decorative handle to receive a fastening screw and thereby secure the decorative handle to the adapter.

U.S. Pat. No. 4,842,009 discloses an adapter kit for a valve handle wherein an adapter has a shank on one end to be received in the cavity of a valve handle and has a socket opening to its opposite end with an extender socket to receive the shank of another extender, or in the alternative one of a plurality of spuds having external configuration for complementary receipt in the spud socket, adapter socket or extending socket. The adapter kit can adapt a handle to a wide variety of broach sizes and offset distances.

U.S Pat. No. 4,766,642 discloses a decorative handle having an insert retained in the handle by a retainer assembly comprising a collar member which is threaded on to the handle from the bottom. The inserts can be readily changed when the room wherein the handle is mounted is remodeled.

U.S. Pat. No. 4,616,673 discloses a replacement faucet handle comprising a plurality of adapters which can be received in the cavity of replacement handles, the plurality of adapters having differing lengths and differing bores to correspond to the differing lengths and diameters of various faucet valve stems.

U.S. Pat. No. 4,189,248 discloses a snap-on handle having a U-shaped spring member in the handle recess, the spring member including a V-shaped hook portion at an intermediate location to seat in an annular notch region between discontinuous longitudinally extending splines, thereby holding the handle to the valve stem.

U.S. Pat. No. 3,965,528 discloses a universal elbow action lever handle which is readily adapted for use with a valve or faucet stem of various sizes and configurations. The handle base includes a tapered interior cavity to receive interchangeable inserts, each of which has a broach to fit a specific valve stem spline.

U.S. Pat. No. 3,582,116 discloses a stem extension for plumbing fixtures which may be of any particular length desired to enable securing the usual escutcheon and handle on the stem of the valve body, even though the valve body may not have been mounted correctly relative to the wall through which the valve stem is supposed to extend.

U.S. Pat. No. 3,386,306 discloses a switch having an actuating cam of rigid thermoplastic material with a sleeve insert of yieldable thermoplastic material, the insert having a cavity to receive an actuating shaft. A knob is secured to the other -end of the shaft. A connector of similar thermoplastic material has an opening at one end to receive such other end of the shaft and has a knob engaging extension telescoped in an opening of such knob. The shaft has a series of fracture grooves to sever parts of the shaft to tailor it to a desired length. A variety of such sleeve inserts can be used with the switch each having a cross-section corresponding to that of the particular shaft that is to be used.

U.S. Pat. No. 3,313,057 discloses color code caps for knobs, comprising plastic disks which may be inserted in the exposed ends of knobs, the-knobs being of distinctive colors or otherwise marked to distinguish from adjacent knobs. The plastic disks may be inserted in a recess of the knobs and are constructed so that they can be removed from the knobs and different disks inserted. The color coded knobs can thus be taken from one piece of equipment and used on another if and when desired.

U.S. Pat. No. 3,250,148 discloses an adjustable handle for stem operated devices, which receives any one of a plurality of insert members in the bore of the handle, the insert members having stem receiving cavities of different sizes and configuration to receive valve stems of corresponding different sizes and configurations.

U.S. Pat. No. 2,047,703 discloses a valve handle having a cubical insert that can be made to fit a variety of different valve stems by use of a set screw through the side wall of the insert.

U.S. Pat. No. 1,936,109 discloses a handle which can be used with a variety of valve stems by use of an adapter bar slidably receivable transversely of the stem facing side of the handle, the adapter bar having an opening to receive the valve stem having the same size and configuration of the valve stem for which the particular adapter is made.

U.S. Pat. No. 1,878,569 discloses a handle which can be used with a variety of valve stems by providing an oversize hub cavity in the central hub of the handle with four arcuately spaced apart threaded apertures through the hub cavity wall to receive case hardened set screws. A valve stem of any size or configuration can be received in the oversize hub cavity, and the four set screws are then tightened against the valve stem to hold it against rotation relative to the handle so it can be rotated when the handle is rotated.

U.S. Pat. No. 1,829,371 discloses a valve handle which can be used with a variety of valve stems by providing a circular disk insert having a plurality (four as shown) of stem receiving apertures configured (square as shown) to match the configuration of the valve stem and of different cross-sectional dimension to accommodate valve stems of different cross-sectional dimension, the disk insert being rotatable within the recess of the valve handle to enable centering the particular stem receiving aperture which matches the stem on which the valve handle is to be used, co-operative notches in the periphery of the disk and recess being provided to hold the disk in the desired position when the selected aperture has been centered within the valve handle.

U.S. Reissued Pat. No. RE 251 which discloses a knob having a central cavity and a plurality of inserts receivable therein which in turn each have cavities of differing cross-sectional configuration and dimension to receive valve stems or shafts of corresponding differing cross-sectional configurations and dimensions.

French Patent 1,516,995 discloses a plurality of crank handle devices having differing cavities to receive corresponding differing shafts.

United Kingdom Patent 1,054,302 discloses a knob having a cavity to receive a spindle with an enlarged conical end, the cavity being compressible to fully receive the enlarged conical end after which an outer annular end portion of the compressible cavity expands to its original dimension to form an annular shoulder bearing against the enlarged conical end of the .spindle to substantially prevent or impeded its withdrawal from the knob cavity.

SUMMARY OF THE INVENTION

The window crank assembly in accordance with the present invention is an improvement over those disclosed in the foregoing patents. A metal window crank is provided for the crankshaft of casement windows whose outermost portion extends no more than about a half inch, or less, from the outer end of the casement window crankshaft when fully received in the insert cavity of one of a plurality of plastic or metal inserts receivable in the hub cavity of the window crank.

The window crank in accordance with this invention has a pair of laterally extending blades or wings which extend outwardly from the central hub in opposite directions to provide a hand grasp. The upper edge of each wing or blade extends from their respective outer ends in an inwardly extending arc to meet at the apex of the arc which is in line with the axis of the hub cavity and which is the outermost portion of the window crank when the casement window crankshaft is received in the insert cavity which is in turn received in the hub cavity of the crank.

A plurality of inserts, which are preferably metal but may also be plastic, are provided in a kit which includes one metal window crank. Each of the inserts has an outer peripheral side wall of cross-sectional configuration and dimension corresponding to that of the inner peripheral side wall of the hub cavity for snug reception therein. The peripheral side wall of the insert and hub cavity have a corresponding plurality of longitudinally extending flats which have different lateral dimensions. In order for the inserts to be received in the hub cavity, the flats of the insert have to be lined up with the corresponding flats of the hub cavity whereby they can only be inserted into the hub cavity one particular way.

A threaded aperture extends through the hub cavity wall which is in registration with an unthreaded aperture through the side wall of the insert. Since the insert can only be received in the hub cavity one way by lining up the longitudinal flats of differing lateral dimension of both the insert and the hub cavity, the apertures will always come into proper registration when the insert is fully received in the hub cavity.

A set screw is threaded through the hub cavity wall to extend through the unthreaded aperture through the side wall of the insert to bear against a portion of the casement window crankshaft received in the cavity of the insert, at a location inwardly of the outwardly projecting splines of the crankshaft. Thus, when the window crank in accordance with this invention is in place on the crankshaft of a casement window operator and the set screw tightened against the shaft, the window crank and its insert cannot be pulled away from the casement window crankshaft until the set screw has been loosened enough to clear the outwardly projecting splines of the shaft.

Each of the plurality of plastic inserts provided in each kit has an insert cavity with a peripheral side wall having a different cross-sectional dimension and configuration of splines corresponding to that a plurality of different crankshafts of casement window operators used by different manufacturers of casement windows. A purchaser can thereby purchase one of the window crank kits in accordance with this invention without at the time knowing the particular size and configuration of the crankshaft of his casement window operators. He can then try the respective inserts on the crankshaft without removing it from the window until he finds the right one that fits. Such insert can then be placed in the hub cavity of the metal crank member by lining up the corresponding different lateral dimension flats, whereupon the apertures of the crank member and insert come into registration. With the crankshaft of the casement window operator fully received in the insert cavity, and the splines projecting from the inner wall of the insert cavity engaged with the splines projecting outwardly from the crankshaft, the set screw extending through both the hub of the crank member and the side wall of the insert is then tightened against the crankshaft at a point inwardly thereof from its enlarged outwardly projecting spline portion.

By constructing the window crank in such a way that it cannot be removed from the casement window crankshaft without loosening the set screw, a safety feature is provided whereby a child for example cannot inadvertently pull the crank member away from the insert, or pull the combined crank member with its insert away from the casement window crankshaft. If inadvertently removed, a child could throw a window crank against a window or other object or person, causing damage or injury, or he may attempt to place it in his mouth.

DESCRIPTION OF PREFERRED EMBODIMENT

Figure 1:
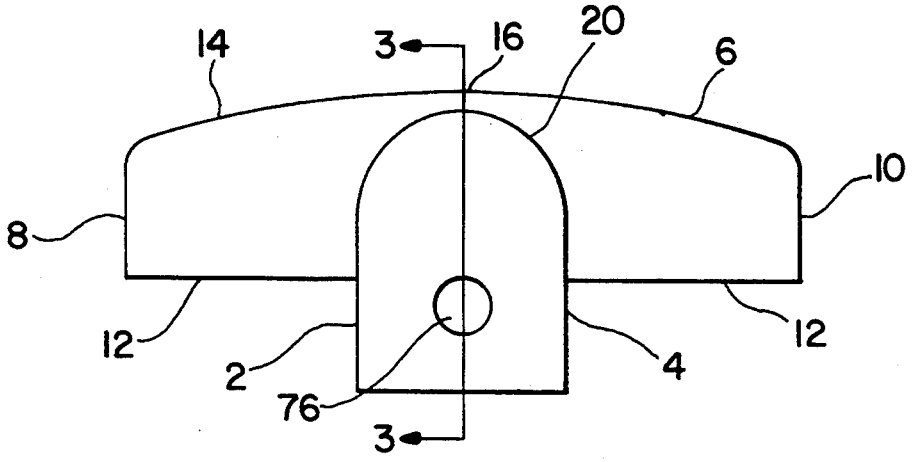
FIG. 1 is a side elevation view of a casement window crank in accordance with this invention.
Figure 2:
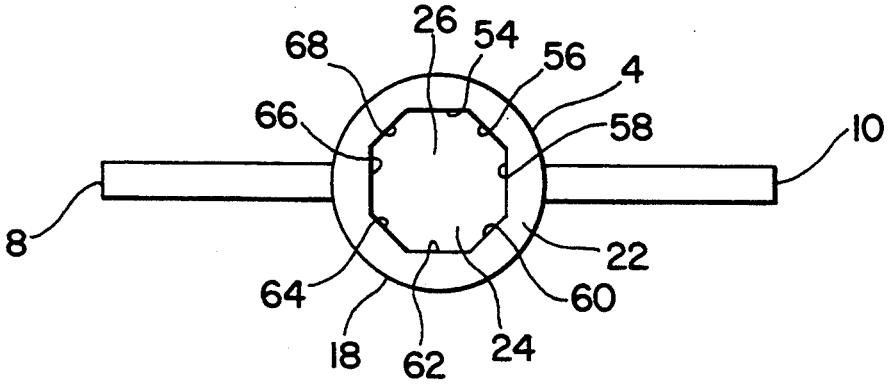
FIG. 2 is a bottom plan view of the window crank of FIG. 1.
Figure 3:
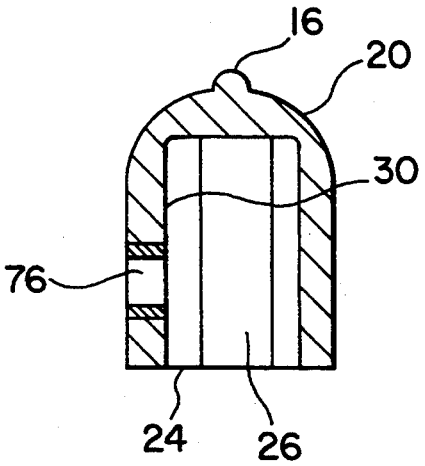
FIG. 3 is a section view taken on line 3—3 of FIG. 1.
Figure 4:
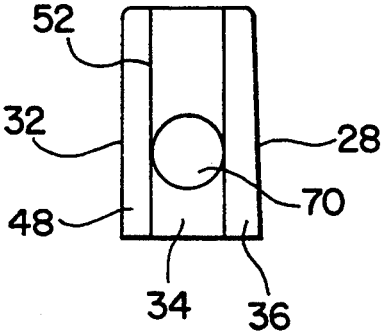
FIG. 4 is a side elevation view of an insert member which is received in the hub cavity of the window crank of FIG. 1.
Figure 5:
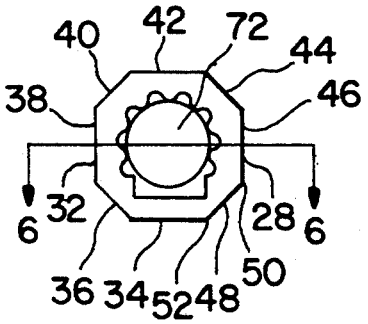
FIG. 5 is a bottom plan view of the insert member of FIG. 4.
Figure 6:
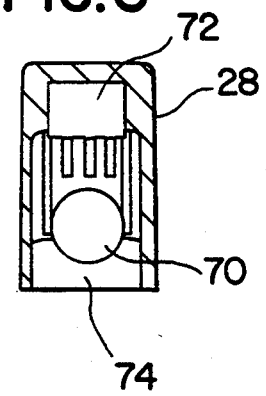
FIG. 6 is a section view taken on line 6—6 of FIG. 5.
Figure 7:
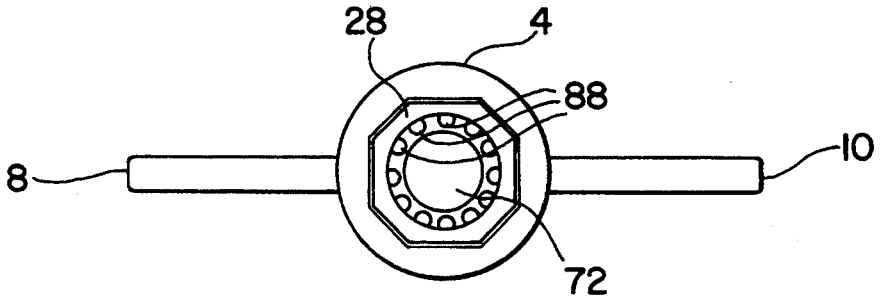
FIG. 7 is a bottom plan view of a window crank as shown in FIG. 1 having an insert member as shown in FIG. 4 received in its hub cavity.
Figure 8:
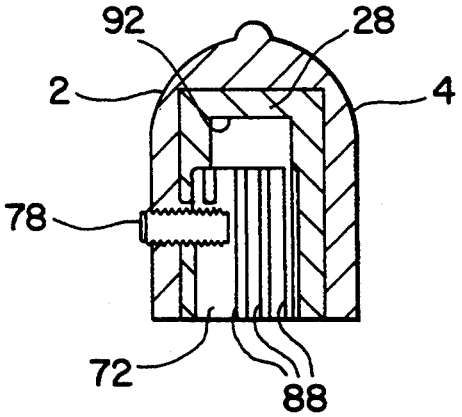
FIG. 8 is a section view of a window crank with insert member therein as shown in FIG. 7, having a set screw through the threaded aperture of the hub and extending through the corresponding unthreaded aperture of the insert member.
Figure 9:
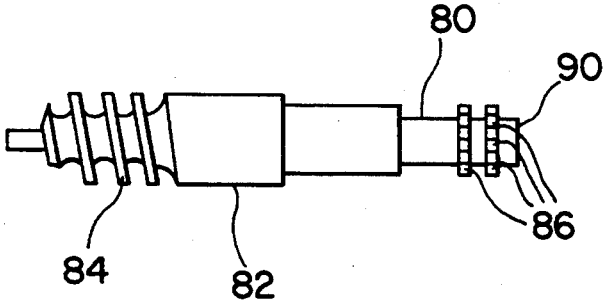
FIG. 9 is a side elevation view of one of the casement window operator shafts on which the window crank in accordance with this invention may be used.
Figure 10:
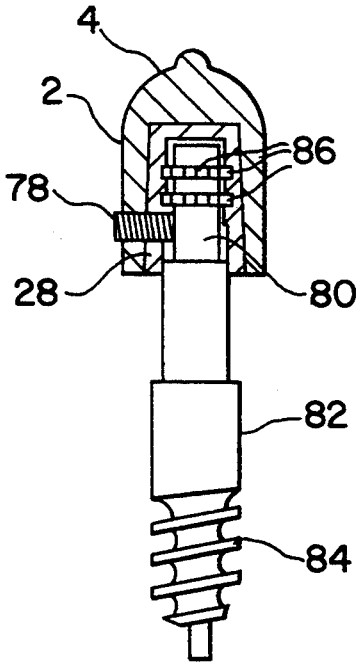
FIG. 10 is an elevation view of a casement window operator shaft and a section view of a window crank in accordance with this invention in place thereon.
Figure 11:
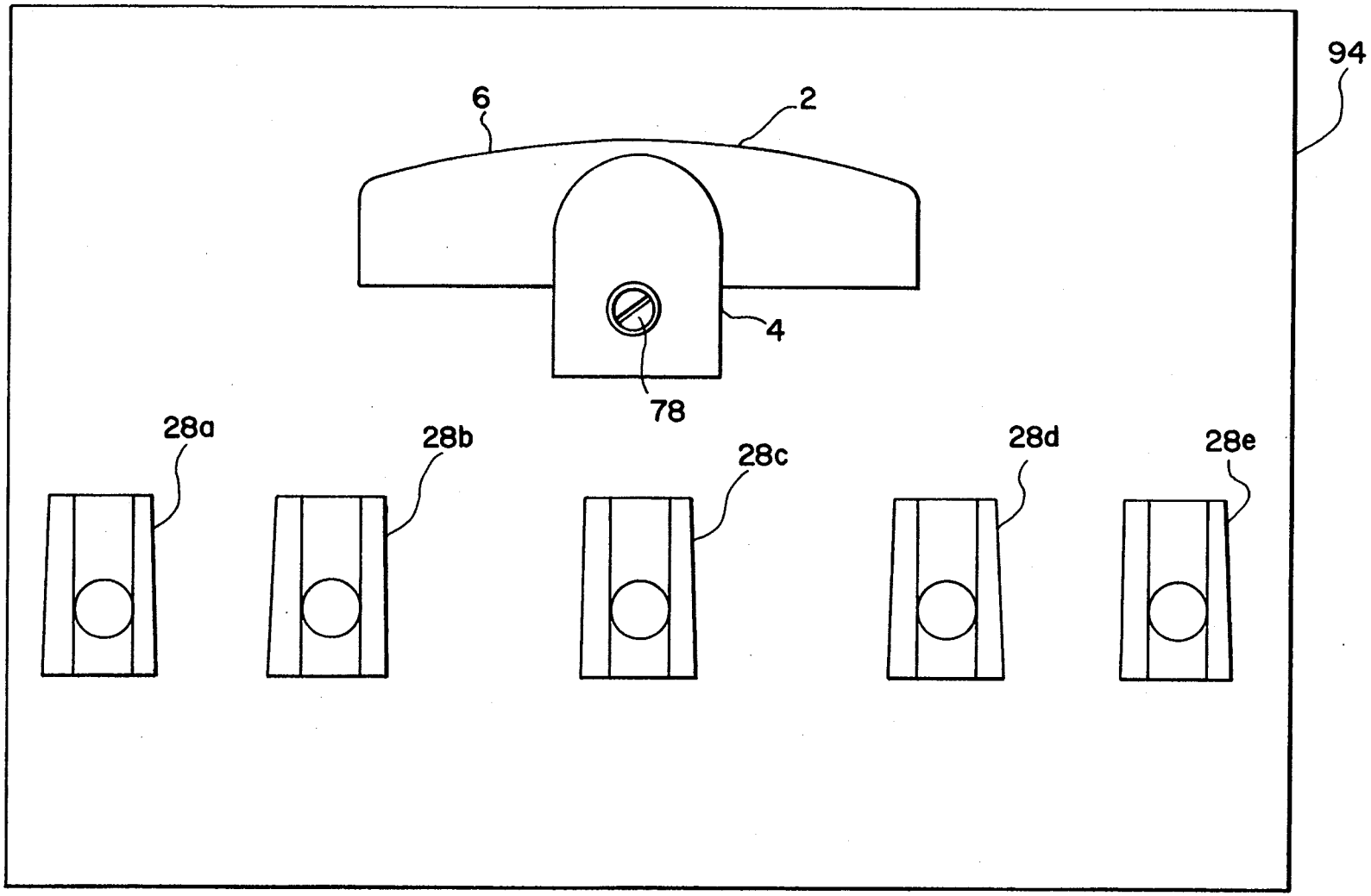
FIG. 11 is a plan view of a kit in accordance with this invention comprising one window crank and a plurality of insert members which may be received in the hub cavity of the window crank, each insert member having an insert cavity of differing cross-sectional dimension and differing spline configuration to correspond with the differing cross-sectional dimension and spline configuration of the casement window operator shafts used by different casement window manufacturers.

A window crank assembly for casement windows in accordance with the present invention comprises crank body 2 having a central hub 4 and a laterally extending hand grasp member 6 comprising a first planar blade or wing 8 extending outwardly in one direction from the hub 4 and a second planar blade or wing 10 extending outwardly in the opposite direction from the hub 4. Each blade or wing 8 and 10 has a straight lower edge 12 and blade or wing 8 and 10 are joined by an arcuately extending upper edge 14 whose apex 16 is in line with the longitudinal axis of the central hub 4.

The central hub 4 includes a cylindrical outer wall 18, a hemi-spherical closed upper end 20 and an open lower end 22 having an entrance aperture 24 opening to a central hub cavity 26 to receive an insert 28 therein.

The inner side wall 30 of the hub cavity 26 and the outer side wall 32 of the insert 28 have a corresponding non-rotatable peripheral configuration whereby the insert 28 is receivable in the hub cavity 26 and when received therein is held against rotation relative thereto by virtue of such non-rotatable peripheral configuration.

In the embodiment shown and described herein, the peripheral outer side wall 32 of the insert 28 includes a first longitudinally extending flat 34 having a first lateral dimension, for example 0.260 inches, a second longitudinally extending flat 36 having a second and different lateral dimension, for example 0.160 inches, adjacent to the first longitudinally extending flat 34, a third longitudinally extending flat 38 having a third and different lateral dimension, for example 0.230 inches, adjacent to the second longitudinally extending flat 36, a fourth longitudinally extending flat 40 having a fourth and different lateral dimension, for example 0.200 inches, adjacent to the third longitudinally extending flat 38, a fifth longitudinally extending flat 42 having a fifth lateral dimension substantially the same as that of the fourth longitudinally extending flat 40 to which it is adjacent, a sixth longitudinally extending flat 44 having a sixth lateral dimension substantially the same as that of the fourth and fifth longitudinally extending flats 40 and 42 and adjacent to the fifth longitudinally extending flat 42, a seventh longitudinally extending flat 46 having a seventh lateral dimension, for example 0.230 inches substantially the same as that of the third longitudinally extending flat 38, adjacent to the sixth longitudinally extending flat 44, and an eighth longitudinally extending flat 48 having an eighth lateral dimension, for example 0.160 inches substantially the same as that of the second longitudinally extending flat 36, adjacent to the seventh longitudinally extending flat 46 along one side edge 50 and adjacent to the first longitudinally extending flat 34 along its opposite side edge 52, to thereby complete the peripheral configuration of the outer side wall 32 of the insert 28.

The inner side wall 30 of the hub cavity 26 includes eight corresponding longitudinally extending flats comprising first inner side wall flat 54 having a lateral dimension corresponding to that of the first outer wall insert flat 34, a second inner side wall flat 56 having a lateral dimension corresponding to that of the second outer wall insert flat 36, a third inner side wall flat 58 having a lateral dimension corresponding to that of the third outer wall insert flat 38, a fourth inner side wall flat 60 having a lateral dimension corresponding to that of the fourth outer wall insert flat 40, a fifth inner side wall flat 62 having a lateral dimension corresponding to that of the fifth outer wall insert flat 42, a sixth inner side wall flat 64 having a lateral dimension corresponding to that of the sixth outer wall insert flat 44, a seventh inner side wall flat 66 having a lateral dimension corresponding to that of the seventh outer wall insert flat 46, and an eighth inner side wall flat 68 having a lateral dimension corresponding to that of the eighth outer wall insert flat 48.

A circular aperture 70 is provided through the side wall 32 of the insert 28 located on the first longitudinally extending flat 34, having a diameter which is substantially equal to the lateral dimension of the flat 34, for example 0.260 inches, and centered on such flat having its center located inwardly of the insert cavity 72 from its open lower end 74 a distance of about 0.265 inches in the preferred embodiment of the invention as shown and described herein.

The longitudinal dimension of the outer side wall 32 of the insert 28 corresponds with that of the inner side wall 30 of the hub cavity 26 for reception of the insert 28 completely in the hub cavity 26.

The cylindrical outer wall 18 of the central hub 4 includes a circular aperture 76 therethrough located at a point which intersects the first inner side wall flat 54 of the inner side wall 30 of the hub cavity 26 about the same distance inwardly of the hub cavity 26 from the open lower end 22 of the hub 4 as the aperture 70 is inwardly of the insert cavity 72 from the open lower end 74 of the insert 28. Thus, when the insert 28 is fully received within the hub cavity 26, the hub aperture 76 is in registration with the insert aperture 70.

The hub aperture 76 is internally threaded for threaded engagement of the set screw 78 when received therein. When the set screw 78 is rotated in the direction for insertion, it is received through the non-threaded insert aperture 70 and extends into the insert cavity 72 to bear against the shank 80 of the crankshaft 82 of the casement window operator 84 at a location below the outwardly projecting splines 86. The set screw 78 thereby holds the window crank in accordance with this invention to the crankshaft 82 of the casement window operator 84 so it cannot be removed until the set screw 78 is rotated in the opposite direction for removal far enough for its inwardly projecting end to clear the splines 86 of the casement window operator 84.

The insert cavity 72 has a diameter corresponding to that of the crankshaft 82 of the casement window operator 84 and has longitudinally extending, inwardly projecting splines 88 of corresponding spacing and dimension to receive and engage the outwardly projecting splines 86 on the shaft 82 of the casement window operator 84.

When the window crank in accordance with this invention is in place on the casement operator 84, with its crankshaft 82 fully received in the insert cavity 72, the apex 16 of the arcuately extending upper edge 14 of the laterally extending winged hand grasp member 6 is only about an eighth to less than a half of an inch outwardly from the outer end 90 of the crankshaft 82 of the casement window operator 84, and of the upper closed end 92 of the insert 28. Such distance is preferably less than the cross-sectional dimension of the insert cavity 72 and of the corresponding cross-section of the crankshaft 82. In other words, the outermost portion of the window crank in accordance with this invention does not extend significantly beyond the crankshaft 82 of the casement window operator 84. This enables the window crank in accordance with this invention to eliminate annoying interference with window blinds and drapes which occurs with other types of casement window cranks.

The crank body 2, central hub 4, laterally extending hand grasp member 6 and the first and second blades or wings 8 and 10 are made of metal. The set screw 78 is made of metal. The inserts 28 may be made of a synthetic plastic material, but if desired they may also be made of metal.

The outer peripheral side wall 32 of the insert 28 has a slight taper or draft of about one degree converging inwardly as it extends upwardly from the open lower end 74 to the closed upper end 92 to facilitate removal of the inserts from the cavity molds in which they are made.

The window crank assembly in accordance with this invention includes a plurality of inserts 28, including insert **28*a*, insert 28*b*, insert 28*c*, insert 28*d*, and insert 28*e* having insert cavities 72 of differing cross-sectional dimensions and differing spline configurations to receive and operate crankshafts 82 of differing cross-sectional dimensions and differing spline configurations used by different manufacturers of casement windows. A plurality of inserts 28*a*, 28*b*, 28*c*, 28*d* and 28*e*, having insert cavities 72 which correspond to the crankshafts 82 of all of the major casement window manufacturers are provided in a kit 94 together with a single crank body 2. The purchaser may then try each of the inserts 28 on the crankshafts of his casement windows until he finds the one that fits. That insert 28 is then inserted into the hub cavity 26 of the crank body 2. Since both the insert 28 and hub cavity 26 have outer and inner peripheral walls with a plurality of corresponding flats of differing lateral dimensions, the insert 28 can be inserted into the hub cavity 26 only one way. In particular, the first flat 34 of the outer side wall 32 of the insert 28 must be in line with the first inner side wall flat 54 of the hub cavity 26 for the insert 28 to enter the hub cavity 26. Such construction enables the non-threaded aperture 70 through the side wall 32 of the insert and the threaded aperture 76 through the outer wall 18 of the central hub 4 to come into registration when the insert 28 is fully received in the hub cavity 26**.

The set screw 78 is threadedly received in the threaded aperture 76 and rotated in the direction of insertion until it begins to project into the aperture 70 of the insert 28. The crank body 2 with the correct insert 28 in place is then centered over the crankshaft of the casement window and moved downwardly to receive the crankshaft in the insert cavity 72 until it has become fully inter-engaged with the splines or other co-operating drive means of the corresponding insert cavity 72. The set screw 78 is then rotated further in the insertion or tightening direction until it bears against the crankshaft 82 at a point below its outwardly projecting splines or other co-operating drive means. When the set screw is thus tightened, the crank assembly in accordance with this invention cannot be removed from the crankshaft 82 until the set screw 78 is loosened enough for the outwardly projecting splines or other co-operating drive means on the crankshaft to clear.

The crank assembly in accordance with this invention when placed on the crankshaft of the casement window as described is now ready for use.

We claim:

1. A crank assembly for rotating a crankshaft, comprising a crank member having a central hub, a hub cavity extending longitudinally thereof opening to one end of said hub facing in a first longitudinal direction, said hub cavity extending in the opposite second longitudinal direction and terminating at an inward hub cavity end, an insert member receivable in said hub cavity, first rotational holding means to hold said insert member from rotation within said hub cavity relative to said hub, said insert member having an insert cavity extending longitudinally thereof opening to one end of said insert member facing in said first longitudinal direction, said insert cavity extending in said opposite second longitudinal direction and terminating at an inward insert cavity end, an outermost portion of said crank member spaced apart outwardly of said inward insert cavity end in said second longitudinal direction a predetermined short distance when said insert member is received in said hub cavity, a said crankshaft being receivable in said insert cavity, second rotational holding means of said insert cavity to hold said crankshaft from rotation within said insert cavity relative to said insert member whereby said crankshaft may be rotated when said insert member and said hub are rotated, and longitudinal holding means to hold said insert member and said hub from longitudinal movement relative to said crankshaft in the direction of removal therefrom beyond a predetermined point, said longitudinal holding means including longitudinal abutment means for abutting against a portion of said crankshaft when said crankshaft is urged in the direction of removal from said insert member and said hub beyond said predetermined point.

2. A crank assembly for rotating a crankshaft as set forth in claim 1, wherein said first rotational holding means comprises an inner peripheral side wall of said hub cavity, said inner peripheral side wall of said hub cavity having a first inner side wall flat extending longitudinally thereof and having a first lateral dimension, an outer peripheral side wall of said insert member, said outer peripheral side wall of said insert member having a first longitudinally extending outer side wall flat having a lateral dimension corresponding to said first lateral dimension, said first inner side wall flat of said hub cavity and said first outer side wall flat of said insert member being in full facing relationship when said insert member is received in said hub cavity to thereby hold said insert member from rotation relative to said hub cavity.

3. A crank assembly for rotating a crankshaft as set forth in claim 1, wherein said central hub includes a peripheral side wall, said insert member includes a peripheral side wall, said longitudinal holding means comprises an internally threaded first aperture through said peripheral side wall of said central hub to receive an externally threaded set screw, including said externally threaded set screw, a second aperture through said peripheral side wall of said insert member for registration with said first aperture and to receive said set screw therethrough when said insert member is received in said hub cavity, said crankshaft receivable in said insert cavity having an outermost end adjacent to said inward insert cavity end when received in said insert cavity, an enlarged cross-sectional portion of said crankshaft inwardly of its said outermost end, said longitudinal abutment means including said first and second apertures and said set screw being positioned for said set screw to contact said crankshaft at a point inwardly of its said enlarged cross-sectional portion when said insert member is received in said hub cavity and said crankshaft is received in said insert cavity to thereby hold said insert member and said hub from longitudinal movement relative to said crankshaft in the direction of removal therefrom beyond a predetermined point, such predetermined point being the location of said enlarged cross-sectional portion of said crankshaft.

4. A crank assembly for rotating a crankshaft as set forth in claim 3, wherein said crank assembly includes insert orientation means to correctly position said insert member for insertion into said hub cavity whereby said second aperture of said insert member will come into registration with said first aperture of said central hub when said insert member is received in said hub cavity.

5. A crank assembly for rotating a crankshaft as set forth in claim 1, wherein said crank member includes a low profile hand grasp structure comprising a first wing member extending laterally outwardly from said central hub in one direction, a second wing member extending laterally outwardly from said central hub in the opposite direction, said first wing member being positioned substantially in line with said second wing member, said first wing member having a laterally extending upper edge, said second wing member having a laterally extending upper edge, said upper edge of said first wing member being integrally joined with said upper edge of said second wing member at said outermost portion of said crank member.

6. A crank assembly for rotating a crankshaft as set forth in claim 1, wherein said predetermined short distance said outermost portion of said crank member is spaced apart outwardly of said inward insert cavity end when said insert member is received in said hub cavity is any selected distance between one-eighth of an inch and one-half of an inch.

7. A crank assembly for rotating a crankshaft as set forth in claim 1, wherein said predetermined short distance said outermost portion of said crank member is spaced apart outwardly of said inward insert cavity end when said insert member is received in said hub cavity is no greater than the cross-sectional dimension of the insert cavity of the said insert member.

8. A crank assembly for rotating a crankshaft as set forth in claim 1, including a plurality of additional ones of said insert members receivable in said hub cavity, each of said additional insert members having a said insert cavity extending longitudinally thereof opening to one end of said insert member facing in said first longitudinal direction, said insert cavity of each of said additional insert members extending in said opposite second longitudinal direction and terminating at a said inward insert cavity end, said second rotational holding means of said insert cavity of each of said plurality of insert members being different and constructed to inter-engage with corresponding different rotational holding means structure of a plurality of different crankshafts.

9. A crank assembly for rotating a crankshaft as set forth in claim 8, wherein said crank member is made of metal and each of said plurality of additional ones of said insert members is made of plastic.

10. A crank assembly for rotating a crankshaft as set forth in claim 8, wherein said crank member is made of metal and each of said plurality of additional ones of said insert members is made of metal.

11. A crank assembly for rotating a crankshaft as set forth in claim 1, wherein said second rotational holding means of said insert cavity includes a plurality of longitudinally extending splines to inter-engage with a corresponding plurality of longitudinally extending splines around a portion of a said crankshaft receivable in said insert cavity, including said plurality of longitudinally extending splines around a portion of said crankshaft.

12. A crank assembly for rotating a crankshaft as set forth in claim 1, wherein said crank member is made of metal and said insert member is made of plastic.

13. A crank assembly for rotating a crankshaft, comprising a crank member having a central hub, a hub cavity extending longitudinally thereof opening to one end of said hub facing in a first longitudinal direction, said hub cavity extending in the opposite second longitudinal direction and terminating at an inward hub cavity end, an insert member receivable in said hub cavity, first rotational holding means to hold said insert member from rotation within said hub cavity relative to said hub, said insert member having an insert cavity extending longitudinally thereof opening to one end of said insert member facing in said first longitudinal direction, said insert cavity extending in said opposite second longitudinal direction and terminating at an inward insert cavity end, an outermost portion of said crank member spaced apart outwardly of said inward insert cavity end in said second longitudinal direction a predetermined short distance when said insert member is received in said hub cavity, a said crankshaft being receivable in said insert cavity, second rotational holding means of said insert cavity to hold said crankshaft from rotation within said insert cavity relative to said insert member whereby said crankshaft may be rotated when said insert member and said hub are rotated, and longitudinal holding means to hold said insert member and said hub from longitudinal movement relative to said crankshaft in the direction of removal therefrom beyond a predetermined point, wherein said central hub includes a peripheral side wall, said insert member includes a peripheral side wall, said longitudinal holding means comprises an internally threaded first aperture through said peripheral side wall of said central hub to receive an externally threaded set screw, including said externally threaded set screw, a second aperture through said peripheral side wall of said insert member for registration with said first aperture and to receive said set screw therethrough when said insert member is received in said hub cavity, said crankshaft receivable in said insert cavity having an outermost end adjacent to said inward insert cavity end when received in said insert cavity, an enlarged cross-sectional portion of said crankshaft inwardly of its said outermost end, said first and second apertures and said set screw being positioned for said set screw to contact said crankshaft at a point inwardly of its said enlarged cross-sectional portion when said insert member is received in said hub cavity and said crankshaft is received in said insert cavity to thereby hold said insert member and said hub from longitudinal movement relative to said crankshaft in the direction of removal therefrom beyond a predetermined point, such predetermined point being the location of said enlarged cross-sectional portion of said crankshaft, wherein said crank assembly includes insert orientation means to correctly position said insert member for insertion into said hub cavity whereby said second aperture of said insert member will come into registration with said first aperture of said central hub when said insert member is received in said hub cavity, wherein said insert orientation means includes an inner peripheral side wall of said hub cavity, said inner peripheral side wall of said hub cavity having a first inner side wall flat extending longitudinally thereof and having a first lateral dimension, a second inner side wall flat extending longitudinally thereof radially displaced from said first inner side wall flat and having a second lateral dimension which is different than said first lateral dimension, an outer peripheral side wall of said insert member, said outer peripheral side wall of said insert member having a first outer side wall flat extending longitudinally thereof and having a lateral dimension corresponding to said first lateral dimension, a second outer side wall flat extending longitudinally thereof radially displaced from said first outer side wall flat the same as said second inner side wall flat of said hub cavity peripheral side wall is radially displaced from said first inner side wall flat and having a lateral dimension corresponding to said different second lateral dimension, said first aperture of said central hub being radially positioned relative to said first and second inner side wall flats of said hub cavity inner peripheral side wall the same as said second aperture of said insert member is radially positioned relative to said first and second outer side wall flats of said insert member outer peripheral side wall, whereby said first and second outer side wall flats of said insert member must be aligned with respective ones of said first and second inner side wall flats of said hub cavity for insertion of said insert member into said hub cavity thereby correctly positioning and orientating said second aperture of said insert member to be brought into registration with said first aperture of said central hub when said insert member is received in said hub cavity.

14. A crank assembly for rotating a crankshaft as set forth in claim 13, wherein said inner peripheral side wall of said hub cavity includes a third inner side wall flat extending longitudinally thereof and having a third lateral dimension which is different than both said first and second lateral dimensions, said third inner side wall flat being radially displaced from said first and second inner side wall flats, said outer peripheral side wall of said insert member having a third outer side wall flat extending longitudinally thereof and having a lateral dimension corresponding to said third lateral dimension, said third outer side wall flat being radially displaced from said first and second outer side wall flats the same as said third inner side wall flat of said hub cavity peripheral side wall is radially displaced from said first and second inner side wall flats, whereby said first, second and third outer side wall flats of said insert member outer peripheral side wall are in in facing relationship with respective ones of said first, second and third inner side wall flats of said hub cavity inner peripheral side wall when said insert member is received in said hub cavity.

15. A crank assembly for rotating a crankshaft as set forth in claim 14, wherein said inner peripheral side wall of said hub cavity includes a fourth inner side wall flat extending longitudinally thereof and having a fourth lateral dimension which is different than each of said first, second and third lateral dimensions, said fourth inner side wall flat being radially displaced from said first, second and third inner side wall flats, said outer peripheral side wall of said insert member having a fourth outer side wall flat extending longitudinally thereof and having a lateral dimension corresponding to said fourth lateral dimension, said fourth outer side wall flat being radially displaced from said first, second and third outer side wall flats the same as said fourth inner side wall flat of said hub cavity peripheral side wall is radially displaced from said first, second and third inner side wall flats, whereby said first, second, third and fourth outer side wall flats of said insert member outer peripheral side wall are in facing relationship with respective ones of said first, second, third and fourth inner side wall flats of said hub cavity inner peripheral side wall when said insert member is received in said hub cavity.

* * * * *